US005664389A

United States Patent [19]

Williams

[11] Patent Number: 5,664,389

[45] Date of Patent: Sep. 9, 1997

[54] METHOD AND APPARATUS FOR BUILDING CONSTRUCTION

[76] Inventor: Merlin Ray Williams, 655 Garside Ct., San Leandro, Calif. 94579

[21] Appl. No.: 684,993

[22] Filed: Jul. 22, 1996

[51] Int. Cl.[6] ..... E04B 1/92; E04B 1/98; E04H 9/02; E04H 9/14

[52] U.S. Cl. ..... 52/677; 52/92.2; 52/93.1; 52/167.1; 52/295; 52/684; 52/712; 52/713; 52/745.21; 52/DIG. 11

[58] Field of Search ..... 52/741.1, 745.09, 52/745.21, DIG. 11, 93.1, 92.2, 928.1, 295, 712, 677, 684, 713, 167.1

[56] References Cited

U.S. PATENT DOCUMENTS 2,011,018 8/1935 Smith .

*Primary Examiner*—Christopher Kent
*Attorney, Agent, or Firm*—Linval B. Castle

[57] ABSTRACT

A frame structure is strengthned against earthquake shock and disastrous winds by extending some of the foundation rebars above the foundation walls and clamping on extension lengths of rebar and securing them to the ceiling joists. Special clamps are used which tightly secure the rebar and which also may be attached to other frame members of the structure.

9 Claims, 3 Drawing Sheets

METHOD AND APPARATUS FOR BUILDING CONSTRUCTION

This invention relates to small building construction and in particular to a novel method and apparatus for securing a building to its foundation.

BRIEF SUMMARY OF THE INVENTION

Most small buildings such as residential buildings and two or three story apartment and commercial buildings are usually constructed of a wood frame covered with an appropriate wall material. To secure a building against ground settling, flood damage and damage from strong winds and earthquakes, all modern buildings, large and small, are secured to strong, heavy concrete foundations which, in most instances, is several times heavier than the total weight of its overlying structure.

A wood frame building is generally secured to its foundation wall by steel anchor bolts which are embedded from six to eight inches in the concrete foundation and have an exposed threaded end which extends vertically from the foundation wall top and to which horizontal wood sills are bolted. The sills, thus secured to the foundation, are a base to which the remainder of the frame work is fastened. The floor joists with its overlying subfloor may be nailed to the sills and the wall frame including the vertical studs and plates nailed to the joists. If the building has a second floor, the second floor joists and subfloor are nailed to these plates and the second floor wall framework is nailed to the joists. Finally, ceiling joists are nailed to the the plates over the second floor studs and the roof structure is added.

It is apparent that the conventional wood frame building is firmly secured to its foundation only at the sill and that only nails, small fasteners and the weight of the building and its contents hold the building on its foundation. Earthquakes or very strong winds could easily lift parts of the nailed-down frame and cause vertical misalignment of the building or even complete collapse.

This invention is for a very simple and inexpensive method and apparatus for securing a building to its foundation from the top down; that is, tying it to the foundation from its ceiling joists instead of from its sills. A properly engineered foundation typically weighs two to three times the weight of the overlying structure so that securing the structure from its top forms a solid, rigid mass conbining the weights of both the foundation and the structure thereby greatly improving its resistance to damaging quakes and winds. Vertical reinforcing steel bars, or rebar, attached to the foundation and clamped to the ceiling joists, may be used for this purpose.

This procedure has been used in the construction of masonry block buildings. Early U.S. Pat. No. 2,011,018 describes a chimney having vertical tie rods connected to the foundation anchors and threaded at the to of the chimney. Later U.S. Pat. No. 5,138,808 shows vertical tensioning rods attached by wires to a horizontal reinforcing bar in the concrete footing and having an exposed threaded end extending from the top course of masonry blocks. The verticl rods are tensioned after the hollow voids of the blocks are filled with polyurethane foam for heat insulation.

The above patent employs the conventional method for inter-connecting rebars by wiring the rebars together and relying on the concrete to make permanent the connection. The rebar has an irregular surface that grasps the concrete for a tight connection and wiring together rebars prior to embedding them in concrete usually produces an excellent bonding if the concrete completely covers enough of both ends of the rebar. This is made certain by U.S. Pat. No. 5,379,562 which describes a spring wire connector for joining the ends of two rebars that assures adequate and proper spacing between the turns of the spring for the admission of concrete slurry.

This method of wire connecting rebars is not without problems, however, especially in earthquake areas in which has been shown that a severe shock will break even well reinforced concrete columns, leaving a skeleton of unattached but formerly wired together rebars.

Briefly described this invention includes the steps of bending up the ends of the foundation reinforcing bar, hereinafter called rebar, through the sill, clamping an additional vertical length of rebar to the end at the sill and extending the new length vertically between the wall studs and through the plates to the ceiling joist where it is attached by a special clamp that attaches to the rebar and may be nailed to the wood frame. Additional clamps may be clamped to the rebar for stability as required, for example on the first floor plates. It is estimated that a conventional wood frame residence may require ten or more rebar holdowns, depending on the building structure and location.

DESCRIPTION OF THE DRAWINGS

In the drawings which illustrate the preferred embodiment of the invention.

DETAILED DESCRIPTION

Figure 1:
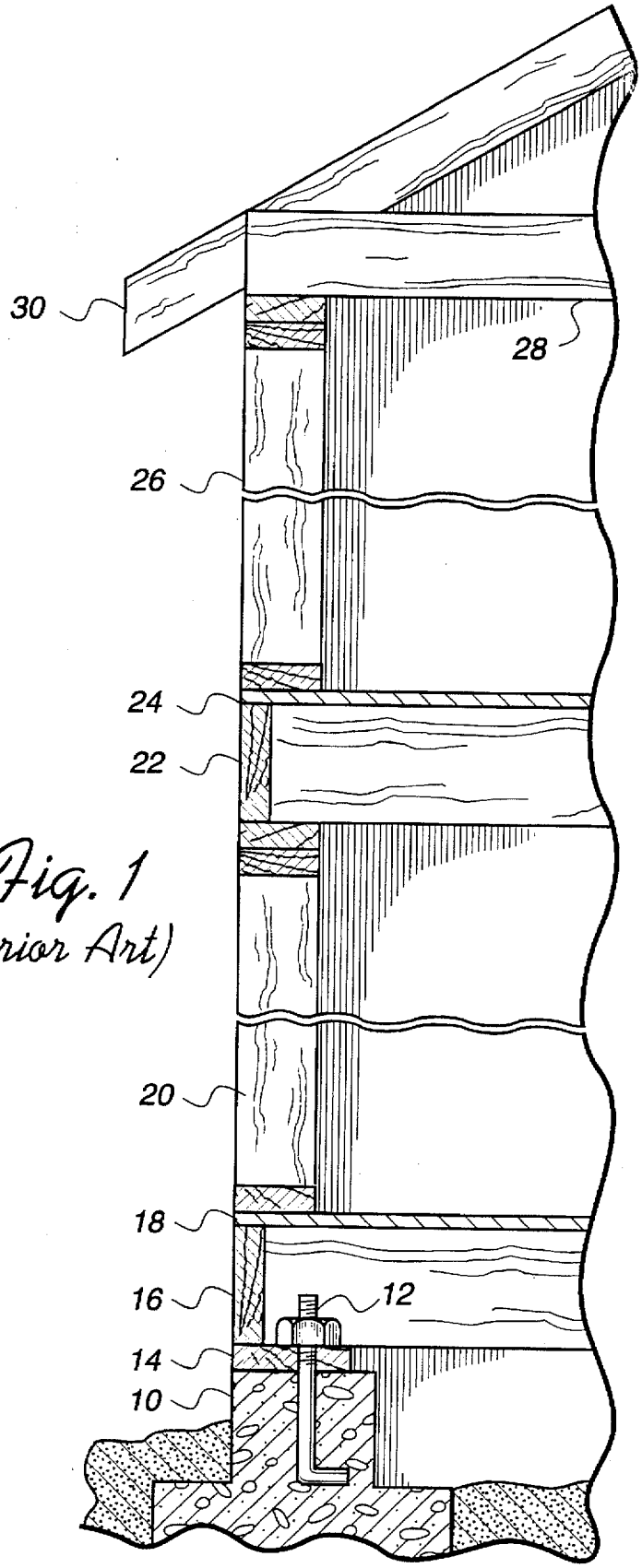
Fig. 1 (Prior Art)
FIG. 1 is a sectional view of a corner of a building illustrating the prior art construction.

A corner of a typical prior art two-story wood frame dwelling is shown in in the sectional drawing of FIG. 1. At ground level is a concrete foundation wall 10 which may be low, as shown, or may be several feet in height depending upon the grade of the lot upon which the dwelling is being built. Very often, to save construction costs in building concrete forms, low foundation walls, such as the foundation wall 10, are built using two or three courses of concrete blocks and filling the voids with concrete.

The foundation wall 10 has anchor bolts 12 embedded from six to eight inches in the concrete foundation with a threaded end exending approximately three inches through the top surface of the concrete. Upon this top surface are placed wooden sills 14 which are firmly secured to the foundation wall 10 by nuts upon the threaded ends of the anchor bolts. Thus the sill 14 is tightly secured to the foundation at regular intervals along its length.

Upon the sill 14 is nailed the floor joists 16 and then the subfloor 18. The wall framing 20 is nailed to the subfloor followed by joists. If it is a single floor dwelling, the joists are ceiling joists; if a multistoried dwelling, the joists are heavier second floor joists 22 followed by a second subfloor 24. Upon this second subfloor is nailed the second floor framing 26 with its plates topped by nailing the ceiling joists 28 and rafters 30. It can be seen that the framing of a dwelling is relatively weak and that everything above the sill 14 is attached to the heavy foundation only by nails, small clips and the strength of any exterior sheathing. A very strong wind or an earthquake could easily loosen those nailed components.

Figure 2:
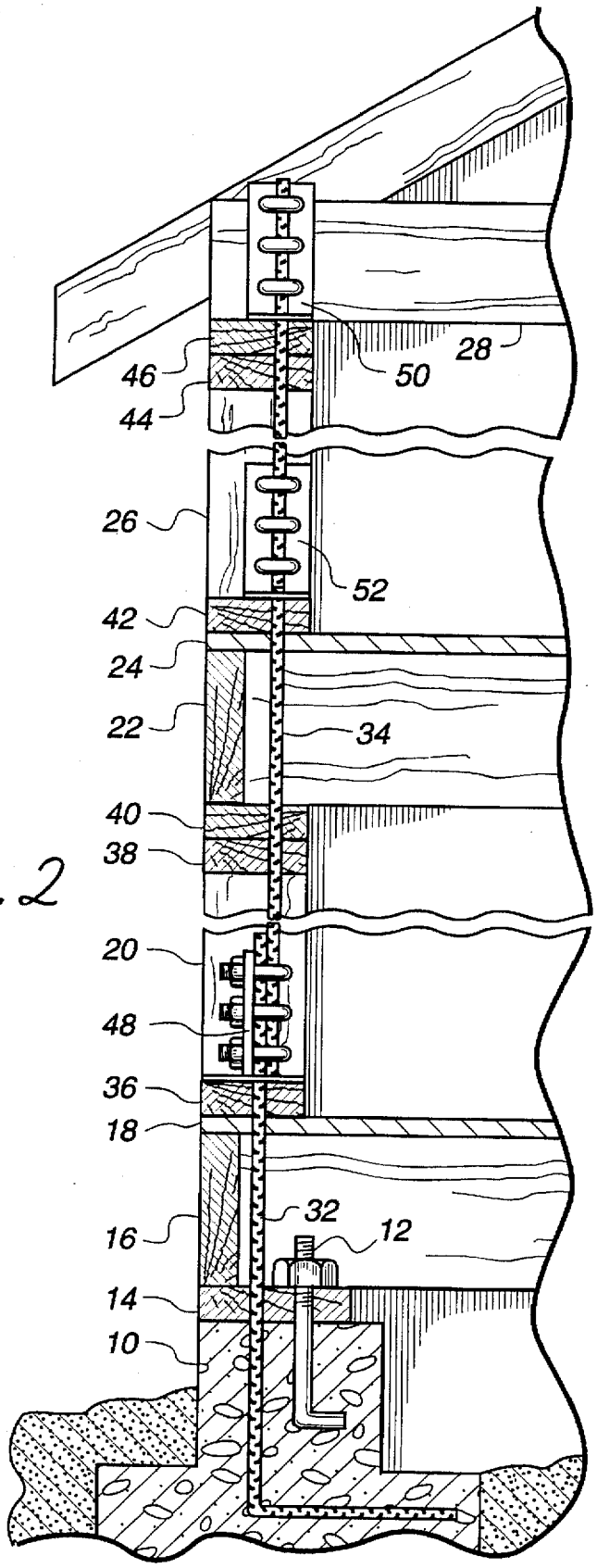
FIG. 2 is a sectional view of a corner of a building illustrating the present invention.

FIG. 2 illustrates my improved method of constructing the same building. All well engineered foundations are laced with bars of reinforcing iron to prevent breakage of the concrete. Instead of extending the free ends of the rebars only to the top surface of the foundation wall 10 and beneath the sill 14, the free end is terminated about two feet above the wall. The sill 14 is drilled to receive both the usual anchor bolt 12 and also drilled for the passage therethrough of the rebar 32. In the preferred embodiment the rebar 32 extends between the floor joists 16 and through the first subfloor 18.

The construction of the dwelling is continued as described as with the prior art FIG. 1. The framing 20 is assembled and nailed to thee subfloor. The second floor joists 22 and subfloor 24 are nailed down and the second floor framing 26 is assembled and nailed to the subfloor 24, topped by the ceiling joists.

After this normal construction, a straight clearance hole for a rebar 34 is drilled through the first floor plate 36, through the plates 38,40, through the second subfloor 24 and plate 42, and through the plates 44, 46, and a length of rebar 34 is inserted so that its upper end extends above the plate 46. The rebar 34 is then firmly clamped by a special clamp 48 that is secured to the top of plate 36 to the free end of the foundation rebar 32. An additional clamp 50 attaches the upper end of rebar 34 to the top of plate 46 and, if desired, a third clamp 52 may secure the second floor plate 42 to the single rebar and to the foundation.

If it is difficult to install a single long length of rebar in the dwelling, the rebar may be installed in shorter lengths which are clamped together with the special clamp to be described. For example, two shorter lengths of rebar may be firmly clamped together by the third clamp 52.

Figure 3:
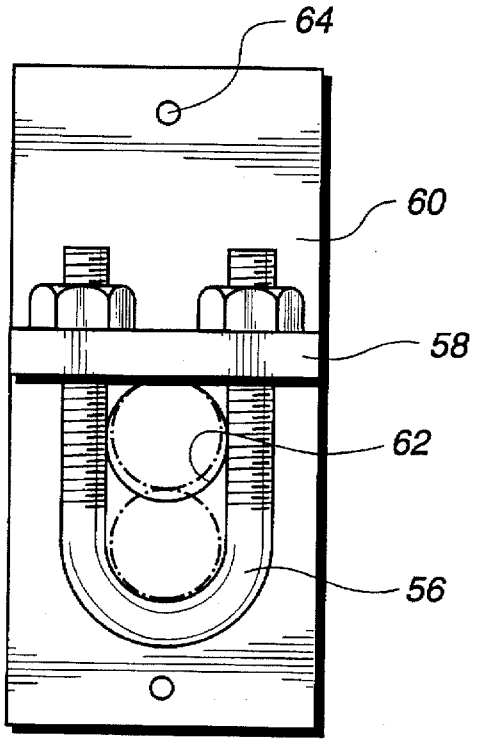
FIG. 3 plan view of the rebar clamp of the invention.
Figure 4:
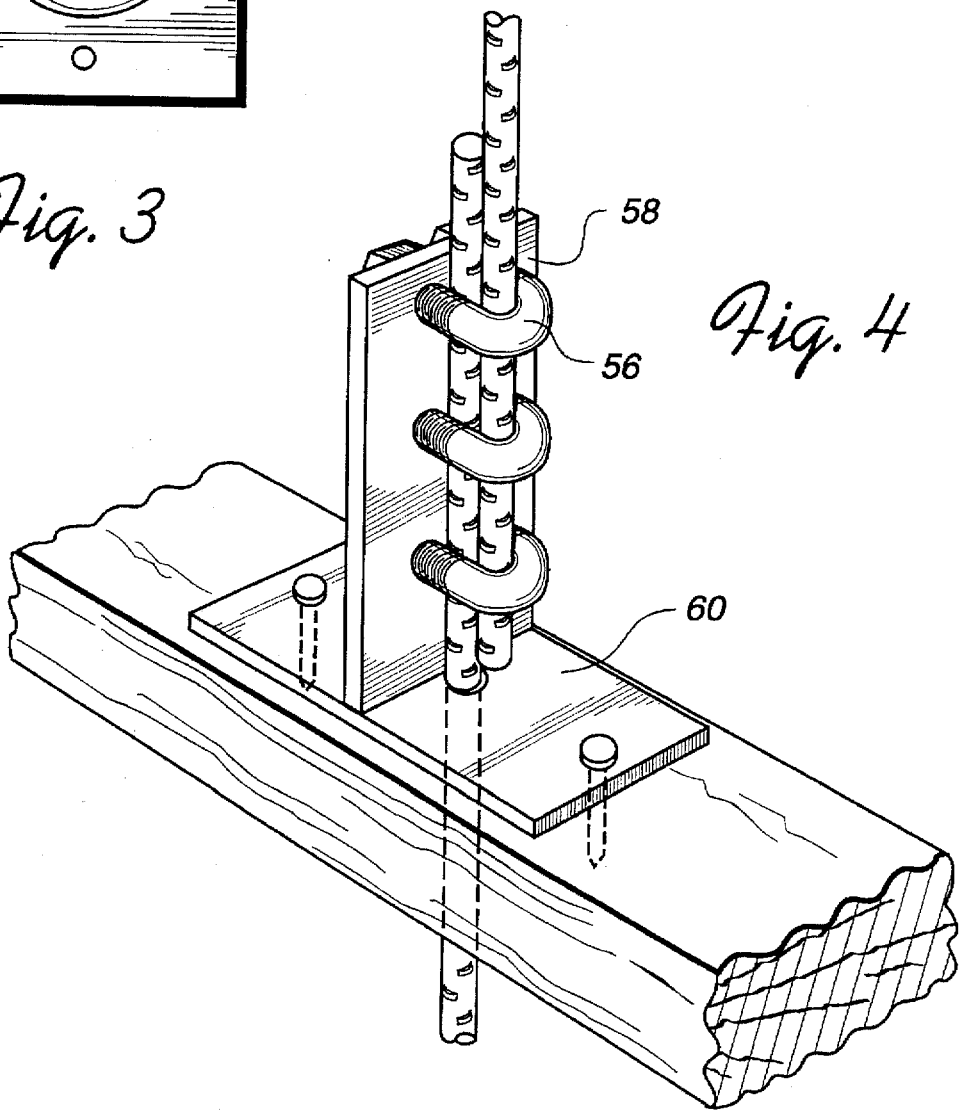
FIG. 4 is a perspective view of the rebar clamp.

The special clamp is illustrateed in the plan view of FIG. 3 and in the perspective view of FIG. 4. The clamp is shaped like the letter, T, and is comprised of three heavy U-bolts 56 in a steel plate 58 the end of which is at a right angle to the center of a second steel base plate 60. The U-bolts have an inside width equal to the diameter of a rebar, are sufficiently long for clamping two rebars, but have the thread length for securing a single rebar against the the plate 58. With the U-bolts tightly clamped around two Group 60, 1 inch rebars, tests show that the special clamp held up to 90,000 pounds of tension.

The end of the U-bolt plate 58 is located at a right angle to the base plate 60 and is tangent to a rebar clearance hole 62 in the base plate so that a rebar may pass through the hole and through the aligned U-bolts. In addition to the hole 62, there are several smaller nailing holes through the plate 60 for nailing the clamp to a wooden member, such as the top of plate 46.

The base plate 60 should be at least 5/16 inches thick steel and should extend at least two inches on each side of the end of plate 58. Base plate 60 will serve a very important function in the event of an earthquake or disasterous wind. Without a base plate, such as plate 60, any force resulting in the separation of the frame of the dwelling would cause the end of the U-bolt plate in the clamp to act as a knife blade to cut through the underlying wooden frame member. The area and thickness of the base plate 60 at the end of the U-bolt plate 58 will prevent this from happening.

Practicing the invention as described and claimed will firmly tie the ceiling joists, the wall section and the floor diaphragm of a building directly together and to its heavy foundation and will prevent any vertical separation of framing members caused by earthquake shock and disastrous winds.

I claim:

1. A method for improving the strength of a building framing having a foundation and foundation wall reinforced with a plurality of rebars, said rebars having ends in the foundation wall, said method comprising the steps of:

extending the end of a selected foundation rebar vertically above the foundation wall;

clamping a first end of an estension rebar having first and second ends to said extending end of said foundation rebar;

clamping the second end of said extension rebar to a building frame member, said second end being positioned vertically above said first end;

said clamping comprising the steps of passing a rebar through a clearance hole in a base plate and against a U-bolt plate at a right angle to said base plate and tangent to said clearance hole, said base plate having a plurality of holes for fastening said base plate to a building member; and tightening at least two U-bolts in holes in said U-bolt plate and aligned with said clearance hole, said U-bolts having arms with a length enabling said U-bolts to clamp at least two rebars and an inside spacing between arms corresponding to a diameter of one rebar.

2. The method claimed in claim 1 including the further step of securing said base plate to a building member.

3. The method claimed in claim 2 wherein the base plate is said step of clamping the first end of said extension rebar is secured to a horizontal building framing member.

4. A method for improving the strength of a building framing having a foundation and foundation wall reinforced with a plurality of rebars, said rebars having ends in the foundation wall, said method comprising the steps of:

extending the end of a selected foundation rebar vertically up above the foundation wall;

boring rebar clearance holes through the building framing at locations directly above said extending end of foundation rebar;

inserting an extension rebar through said clearance holes, said extension rebar having first and second ends;

clamping the first end of said extension rebar to said extending end of selected foundation rebars; and clamping the second end of said extension rebar to a ceiling joist.

5. The method claimed in claim 4 wherein said steps of clamping include the steps of:

passing a rebar through the clearance hole in a base plate and against a U-bolt plate at a right angle to said base plate and tangent to said clearance hole, said base plate having a plurality of holes for fastening said base plate to a building member; and tightening at least two U-bolts in holes in said U-bolt plate and aligned with said clearance hole, said U-bolts having arms with a length enabling said U-bolts to clamp two rebars and with an inside spacing between arms corresponding to a diameter of one rebar.

6. The method claimed in claim 5 including the further step of securing said base plate to a building member.

7. The method claimed in claim 6 wherein the base plate is said step of clamping the first end of said extension rebar is secured to a horizontal building framing member.

8. A clamp securable to a building frame for clamping an end section of a first rebar to a second rebar, the clamp comprising:

a rectangular base plate having top and bottom surfaces, said base plate having therethrough a centrally positioned clearance hole for passage of said second rebar and a plurality of small holes positioned for nailing said base plate to a building frame;

a rectangular U-bolt plate having an end located on the top surface of said base plate and tangent to said clearance hole;

at least two U-bolts in holes in said U-bolt plate, said U-bolts aligned with said clearance hole and having arms threaded to secure at least two rebars and with an inside spacing between arms corresponding to the diameter of one rebar.

9. The clamp claimed in claim 8 wherein said base plate is formed of steel having a thickness of at least ¼ inches.

* * * * *